219-121 SR
8/31/76 XR 3,977,478

United States Patent [19]
Shuck

[11] 3,977,478
[45] Aug. 31, 1976

[54] METHOD FOR LASER DRILLING SUBTERRANEAN EARTH FORMATIONS

[75] Inventor: Lowell Z. Shuck, Morgantown, W. Va.

[73] Assignee: The Unites States of America as represented by the United States Energy Research and Development Administration, Washington, D.C.

[22] Filed: Oct. 20, 1975

[21] Appl. No.: 624,029

[52] U.S. Cl. ..... 175/16; 219/121 LM; 175/71; 166/308
[51] Int. Cl.[2] ..... E21C 19/00
[58] Field of Search ..... 175/11–16, 175/71; 219/10.55 R, 10.55 A, 10.55 B, 10.55 M, 10.41, 121 L, 121 LM; 299/14

[56] References Cited

UNITED STATES PATENTS

| | | | |
|---|---|---|---|
| 3,461,964 | 8/1969 | Venghiattis | 175/16 X |
| 3,493,060 | 2/1970 | Van Dyk | 175/16 |
| 3,527,198 | 9/1970 | Takaoka | 219/121 LM |
| 3,539,221 | 11/1970 | Gladstone | 175/16 |
| 3,693,718 | 9/1972 | Stout | 175/16 |
| 3,871,485 | 3/1975 | Keenan, Jr. | 175/16 |

*Primary Examiner*—Ernest R. Purser
*Assistant Examiner*—Richard E. Favreau
*Attorney, Agent, or Firm*—Dean E. Carlson; David S. Zachry; Earl L. Larcher

[57] ABSTRACT

Laser drilling of subterranean earth formations is efficiently accomplished by directing a collimated laser beam into a bore hole in registry with the earth formation and transversely directing the laser beam into the earth formation with a suitable reflector. In accordance with the present invention, the bore hole is highly pressurized with a gas so that as the laser beam penetrates the earth formation the high pressure gas forces the fluids resulting from the drilling operation into fissures and pores surrounding the laser-drilled bore so as to inhibit deleterious occlusion of the laser beam. Also, the laser beam may be dynamically programmed with some time dependent wave form, e.g., pulsed, to thermally shock the earth formation for forming or enlarging fluid-receiving fissures in the bore.

5 Claims, 1 Drawing Figure

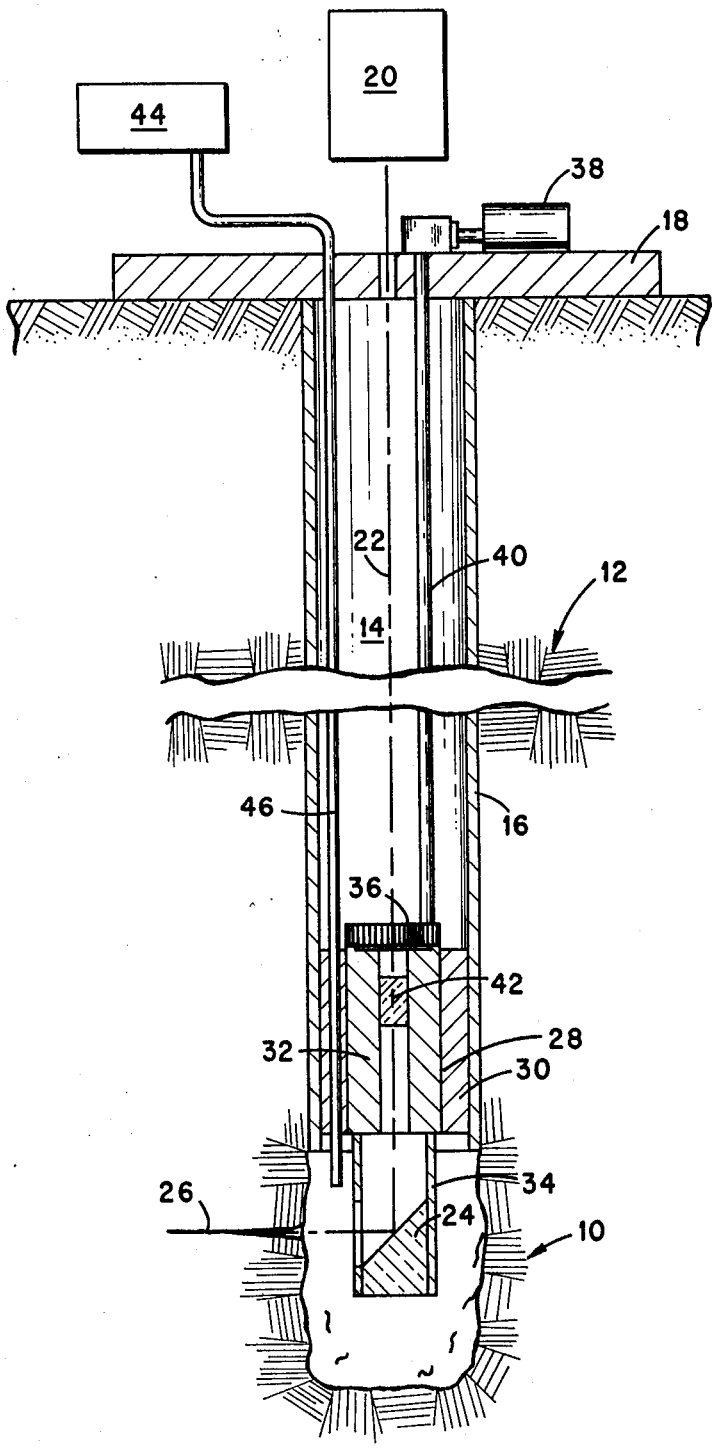
20
44
38
18
22
40
12
14
46
16
36
42
32
28
30
34
26
24
10

METHOD FOR LASER DRILLING SUBTERRANEAN EARTH FORMATIONS

The present invention relates generally to laser drilling subsurface earth formations, and more particularly to a method for effecting the removal of laser-beam occluding fluids produced by such drilling.

The recovery of energy and mineral values from subsurface earth formations by employing laser beams is becoming of increasing interest because of the world's increasing energy demands. In such operations the laser beam energy is suitably collimated and directed against a remote subsurface location via a vertical bore hole and suitable reflecting prisms to effect drilling in a subsurface earth formation at the desired remote location. Typical uses of lasers in subsurface drilling operations are described in U.S. Pat. Nos. 3,461,964; 3,493,060; and 3,693,178. While the aforementioned and other previously employed laser drilling techniques have enjoyed some success, the presence of the loose particles and fluids (gaseous and liquid) generated by the boring action of the laser beam against the subsurface earth formation presented some problems which significantly detracted from the use of laser beams for such drilling operations. For example, the gases and liquids resulting from the laser drilling are excessively opaque to the collimated light beam and tend to remain in the bore produced by the laser so as to absorb the energy of the light beam and thereby inhibit or prevent further drilling by the laser beam. Further, these gases and liquids tend to coat the reflecting device in the bore hole to cause excessive damage and heating thereof as well as inhibit the desired reflection of the beam into the subsurface earth formation.

Accordingly, it is the primary goal or aim of the present invention to provide a method for substantially increasing the efficiency of laser drilling operations in subsurface earth formations by substantially minimizing or overcoming the problems previously encountered due to the presence of the gases and liquids generated by the laser beam during such drilling operations. This goal is achieved by pressurizing the bore hole with a gas transparent to the laser beam to a pressure sufficiently high so that as the laser beam penetrates the subsurface earth formation the high pressure gas will force the fluids resulting from the drilling operation into the fissures and pores surrounding the laser-drilled bore. This step of forcing the laser-opaque fluids into the surrounding earth media assures that the energy in the laser beam will not be sufficiently absorbed so as to impair the drilling or otherwise inhibit the drilling of the bore over a considerable distance from the surface of the bore hole. Further, by removing the generated gases and liquids at the point that they are produced, the occlusion of the mirror or the filling of the bore hole with the opaque fluids is effectively inhibited. Also, if required, the fluid-receiving fissures in the bore may be enlarged by dynamically varying the laser transparent gas pressure throughout the acoustic range of the laser beam as a function of time so as to simultaneously or sequentially thermally and mechanically condition the earth formation and enlarge the fluid-receiving fissures therein.

Other and further objects of the invention will be obvious upon an understanding of the illustrative method about to be described, or will be indicated in the appended claims, and various advantages not referred to herein will occur to one skilled in the art upon employment of the invention in practice.

An apparatus has been chosen for the purpose of illustrating and describing the method of the present invention. The apparatus illustrated is not intended to be exhaustive or to limit the invention to the practice of the method on the precise form of apparatus disclosed. It is chosen and described in order to best explain the principles and steps of the invention and their application in practical use to thereby enable others skilled in the art to best utilize the invention in various embodiments and modifications as are best adapted to the particular use contemplated.

In the accompanying drawing:

The FIGURE is a highly schematic illustration of apparatus which may be used to practice the method of the present invention.

Described generally, the present invention is an improvement in the method of providing elongated bores or passageways in a subterranean earth formation by the steps of directing a collimated monochromatic light beam emanating from a laser generator into a bore hole in registry with an earth formation containing energy or mineral values, and then reflecting the light beam into the earth formation to effect penetration thereof due to the absorption of the energy in the light beam by the earth formation which liquefies and/or gasifies the earth formation to form the elongated bore. The improvement provided by the present method comprises the step of pressurizing the bore hole adjacent to the earth formation with a gas transparent to the light beam with the gas being at a pressure sufficiently greater than the pore pressure in the earth formation to force fluids generated by the absorption of the light beam into pores and fissures in the earth formation contiguous to the elongated bore.

As shown in the accompanying drawing the present invention is practiced upon a subsurface earth strata 10 disposed below below a overburden layer 12 at a depth in the range of about 10 to 2000 feet. The earth strata 10 may contain energy values such as coal, or shale bearing oil or gas; or alternatively the earth formation may contain mineral values recoverable by leaching. With such earth strata the recovery of fluids, such as methane or other gaseous and liquid fuels, and in situ gasification of coal and oil shale retorting may be readily practiced.

To recover the values contained in the earth strata 10 in accordance with the present invention, a vertical bore hole 14 is drilled into the strata 10 and lined with casing 16 in a conventional well-known manner. A mounting structure or platform 18 is placed above the surface of the bore hole for supporting the equipment utilized for practicing the present invention. As shown, a laser beam generator 20, which may be of any suitable, commercially available gas laser in a power range of about 1–5 Kw or larger is used to provide a continuous or time varied, e.g., pulsed, beam 22 of collimated monochromatic light in a beam width of about ⅛ to ¼ inch. This light beam 22 is directed into the bore hole 16 to a location where the beam of electromagnetic energy is reflected into the earth strata 10 at a suitable location thereof by a mirror or reflecting device 24. This reflecting device may be of any suitable construction as normally employed for the reflection of laser beams so as to reflect the latter without distortion or excessive energy absorption. This reflecting device 24 is preferably positioned and angled so as to provide a bore at 45° with respect to the plane of major fractures through the subsurface strata rather than penetrating the plane of major permeability so as to facilitate the recovery of trapped gases and other fluids. The beam of monochromatic light 22 is reflected into the earth strata 10 and bores thereinto due to the absorption of the energy by the earth strata causing the latter to fluidize, gasify or liquefy. As the light beam effects phase changes of the earth strata 10, a straight line bore or passageway, such as shown at 26, extends from the well bore 14.

Preferably, the reflecting device 24 is rotatable about the longitudinal axis of the bore hole so as to radially outwardly deflect the light beam in any desired direction from the bore hole so as to enhance recovery of the energy and mineral values contained in the earth strata 10. This rotation of the reflecting device 24 may be achieved by employing any satisfactory mechanism such as a rotatable structure 28 positioned in the bore hole cavity at any suitable location, such as near the inner end of the casing 16 as shown. The rotatable structure 28 may comprise an annulus 30 affixed to the casing 16 for supporting a relatively displaceable inner member 32 which carries the reflecting device 24 by a suitable bracket 34. The rotation of the inner member 32 may be achieved by employing any suitable mechanism, such as the gears 36 coupled to a drive motor 38 positioned atop the mounting structure 18 through a driveshaft 40. The rotatable structure 28 has a central passageway containing a prism 42 transparent to the laser beam.

Attendant with the melting-boring action of the light beam is the generation of a considerable quantity of gases and liquids from the earth strata due to the absorption of the high energy light beam. As pointed out above, these gases and liquids cloud the reflecting device 24 as well as present opaque energy absorbing bodies to the laser beam so as to interrupt or significantly reduce the effect and the efficiency of the drilling operation. In order to counter the presence of the gases and liquids generated by the drilling operation, a gas transparent to the laser beam is introduced into the bore hole with this gas being at a sufficiently high pressure to force the gases and liquids into fissures and pores in the earth formation defining and surrounding the bore 26. With these gases and liquids being constantly forced into the earth formation 10 by dynamically varying the high pressure gas, the laser beam can continue boring into the earth formation in an efficient manner without encountering light-interrupting atmospheres or without the problem of obscuring the reflecting device so as to cause excessive energy absorption thereby. The pressure found to be adequate for forcing the liquids and gases into the earth strata 10 is in the range of about 50 to 3,000 psig, i.e., about 50 to 3,000 pounds per square inch above the pore pressure, which is equivalent to about 1 psi/ft of depth. Typical gases usable for the present invention include oxygen, nitrogen, and air or any other gas suitably transparent to a particular laser beam wavelength. Oxygen or an oxygen-rich atmosphere is preferably employed so as to aid in the drilling operation.

Further, it has been found that by dynamically varying or pulsing the laser beam at intervals in a range of about 2 milliseconds to 2 seconds apart from one another at frequencies in the range of about 0.5 to 1000 Hz, that the earth strata surrounding the bore 26 may be thermally shocked so as to form or increase the size of the fissures present therearound and thereby increase the capacity thereof for receiving the gases and liquids forced thereinto by the high pressure gas within the well bore 14. The gas is preferably introduced into the bore hole by injecting it from a suitable reservoir 44 via a conduit 46 through the rotatable structure 28. To this end the rotatable structure 28 is preferably sealed to the casing and seals placed between the relatively movable components so as to maintain an airtight construction therein. Of course, if desired, the platform or mounting structure 18 may be sealed at the surface of the bore hole and the entire well bore filled with the high pressure gas which can be dynamically or accoustically varied at some phase or time interval with respect to variation in the laser beam.

The rate of drilling of the earth formation by the laser beam is in a range of about 12 to 15 feet per hour over several hundred feet through sub-bituminous coal and about 6 to 8 feet per hour through bituminous coal and oil shale with a low power (1 kw) laser generator. The higher energy lasers substantially increase the drilling rate.

It will be seen that the present invention provides a substantial improvement in the drilling of subsurface earth strata by employing laser generators. Also, by employing the present invention a relatively small ⅛ inch diameter hole may be drilled in a specific direction, such as parallel or perpendicular to the fracture system of the earth strata, to provide "starter" bores which may be hydraulically or explosively enlarged to establish relatively large, interconnecting, flow channels between several bore holes so as to substantially increase the recovery efficiency especially in processes such as in situ gasification and oil shale retorting. Further, the drilling of small holes through coal beds from a vertical well bore will allow for the development of directional control for in situ recovery processes, such as gasification, combustion, and liquefaction. Still further, the laser drilling technique of the present invention may be employed in shaft or other type mining operations for dewatering and demethanizing purposes which would considerably increase the efficiency and safety of coal removal by conventional mining techniques.

What is claimed is:

1. An improvement in the method for providing an elongated bore in a subterranean earth formation by the steps of directing a collimated monochromatic light beam into a bore hole in registry with the earth formation and reflecting the light beam into the earth formation to effect penetration thereof by causing a phase change in the earth formation to form the elongated bore; said improvement comprising the step of pressurizing the bore hole adjacent to said earth formation with a gas transparent to said light beam, with said gas being at a pressure sufficiently greater than the pore pressure in the earth formation to force fluids generated by the absorption of said light beam into pores and fissures in the earth formation contiguous to said elongated bore.

2. The improved method as claimed in claim 1, wherein said gas is at a pressure in the range of about 50 to 3000 psig, and wherein said gas pressure is selectively varied within said range.

3. The improved method claimed in claim 2, wherein said gas is selected from the group consisting of air, nitrogen, oxygen, and oxygen-rich air.

4. The improved method claimed in claim 2, including the step of pulsing the light beam at frequencies in the range of about 0.5 to 1000 Hz for thermally shocking the earth formation encompassing said bore to form or enlarge said fissures.

5. The improved method claimed in claim 4, including the step of providing a predetermined phase relationship between the gas pressure and light beam.

* * * * *